US005221490A

United States Patent [19]

Tajiri et al.

[11] Patent Number: 5,221,490

[45] Date of Patent: Jun. 22, 1993

[54] RUST-PREVENTIVE LUBRICANT COMPOSITION FOR ZINC-PLATED STEEL MATERIAL

[75] Inventors: Yasuhisa Tajiri; Takafumi Yamaji; Yasuo Okumura; Yasuo Tanizawa; Yoshio Nagae, all of Tokyo, Japan

[73] Assignees: NKK Corporation; NIHON Parkerizing Co., Ltd., both of Tokyo, Japan

[21] Appl. No.: 827,385

[22] Filed: Jan. 29, 1992

[51] Int. Cl.[5] ..... C10M 105/32

[52] U.S. Cl. ..... 252/33; 252/34; 252/39; 252/56 R; 252/56 D

[58] Field of Search ..... 252/56 D, 33, 56 R

[56] References Cited

U.S. PATENT DOCUMENTS

| | | | |
|---|---|---|---|
| 3,030,387 | 4/1962 | Benoit, Jr. | 252/56 D |
| 3,509,052 | 4/1970 | Murphy | 252/56 D |
| 3,522,179 | 7/1970 | Le Suer | 252/56D |
| 3,640,858 | 2/1972 | Harr | 252/56 D |
| 4,159,958 | 7/1979 | de Vries | 252/56 D |
| 4,832,860 | 5/1989 | Katafuchi et al. | 252/56 R |

FOREIGN PATENT DOCUMENTS

| | | |
|---|---|---|
| 53-37882 | 10/1978 | Japan . |
| 60-238392 | 11/1985 | Japan . |
| 60-238393 | 11/1985 | Japan . |
| 60-238394 | 11/1985 | Japan . |

OTHER PUBLICATIONS

Japanese Patent Abstract, 2-110195, C-738 Jul. 9, 1990 vol. 14/No. 318.

Japanese Patent Abstract, 3-162492, C-874 Oct. 9, 1991 vol. 15/No. 398.

Japanese Patent Abstract, 2-167397, C-759 Sep. 17, 1990, vol. 14/No. 43.

Japanese Patent Abstract, 60-238394, C-341 Apr. 22, 1986, vol. 10/No. 10.

Derwent Abstract, 91-320291/44, Jan. 17, 1990.

Japanese Industrial Standard Petroleum Wax JIS K 2235-1980 (Reaffirmed:1985) pp. 1-25 (Revised Oct. 1991).

*Primary Examiner*—Ellen McAvoy

*Attorney, Agent, or Firm*—Birch, Stewart, Kolasch & Birch

[57] ABSTRACT

A lubricant composition effectively enhancing the press-formability, and corrosion-resistance of a zinc-plated steel material and providing a superior, anti-powdering property and degreasing comprises (A) 70 -97% by weight of a lubricant component comprising the sub-components of (a) a succinate of a $C_{12-18}$ aliphatic alcohol, (b) a paraffin wax with a melting point of 45° C. -55° C. and (c) a $C_{12-18}$ fatty acid ester of $C_{6-10}$ aliphatic alcohol and/or a mineral oil, the weight ratio ((a)+(b))/(c) being $\frac{1}{3}$ to 1/1 and the weight ratio (a)/(b) being $\frac{1}{3}$ to 4/1, and (B) 3 to 30% by weight of a rust-inhibiting component comprising a sulfonates with $C_{16}$ or more, a carboxylic acid with $C_{12}$ or more and/or a salt of the carboxylic acid, and has a melting point of 25° C. to 40° C. and an acid value of less than 2.0.

8 Claims, No Drawings

RUST-PREVENTIVE LUBRICANT COMPOSITION FOR ZINC-PLATED STEEL MATERIAL

BACKGROUND OF THE INVENTION

1) Field of the Invention

The present invention relates to a rust-preventive lubricant composition for a zinc-plated steel material. More particularly, the present invention relates to a rust-preventive lubricant composition providing an excellent lubrication of a zinc-plated steel material subjected to a press forming process, and a satisfactory removability thereof after the press-forming process.

2) Description of the Related Arts

Conventional lubricants used in the press-forming of a zinc-plated steel material comprise a press oil and a rust-preventive oil.

Conventional press oils comprise a base oil component composed of an animal or vegetable oil, mineral oil or a synthetic oil, and an additive component comprising an extreme pressure additive and a rust-inhibiting additive. In general, when the conventional press oil is applied to a steel material, the resultant press oil-applied steel material exhibits an enhanced press-formability, but the corrosion resistance of the resultant press-formed steel material and the removability of the press oil from the steel material are unsatisfactory.

The conventional rust-preventive oils comprise a base oil component composed of a mineral oil and a rust-preventive additive component mixed into the base oil component. When the conventional rust-preventive oils are applied to a steel material, the resultant steel material exhibits an unsatisfactory press-formability, although the corrosion resistance of the resultant steel material and the removability of the rust-preventive oils on the resultant steel material are satisfactory.

A steel material treated with a lubricant composition for plastic processing and able to be easily degreased is disclosed, for example, in Japanese Examined Patent Publication No. 53-37882.

In recent years, the degreasing temperature of the press-formed steel material has been lowered to a level of 40° C. to 45° C. Accordingly, when the lubricant composition of the Japanese publication is applied, the resultant steel strip exhibits an unsatisfactory corrosion resistance and is not easily degreased, although the lubrication thereof is enhanced. Namely, the lubricant composition is disadvantageous in that, after the press-forming process, the coated lubricant composition layer remaining on the steel material surface has an unsatisfactory removability.

The conventional lubricants for press-forming processes have been widely applied to cold rolled steel strips, and when the conventional lubricants per se are applied to zinc-plated steel materials, various problems arise. For example, when a zinc-plated steel material is treated with the conventional lubricant composition for a press forming process, and then press-formed, the coated zinc layer on the steel material is deformed or abraded by the tool. In this press forming process, the conventional lubricant composition tends to promote a powdering phenomenon in which a portion of the coated zinc layer on the steel material is broken up and powdered and/or a flaking phenomenon in which a portion of the coated zinc layer is peeled from the steel material surface and flaked.

Also, the conventional lubricant composition promotes an undesirable formation of white rust, which is peculiar to the zinc-plated steel material, and the lubrication by the lubricant composition is affected by the resultant white rust.

In recent years, the use of zinc-plated steel material in the car industry and home electric appliance industry has increased, and thus an improvement in the corrosion resistance of the zinc-plated steel material to be exported is strongly demanded. Further, the zinc-plated steel material must have an enhanced chemical conversion property after press-forming, and a corrosion resistance after paint coating, and the lubricant to be applied to the zinc-plated steel material must provide an improved removability from the press-formed steel material.

Nevertheless, it is difficult to find a satisfactory conventional lubricant meeting the above-mentioned requirements.

Therefore, there is a strong demand for a rust-preventive lubricant useful for a press-forming process of a zinc-plated steel material and providing an excellent lubrication, a superior corrosion resistance, and a satisfactory removability.

SUMMARY OF THE INVENTION

An object of the present invention is to provide a rust-preventive lubricant composition for a zinc-plated steel material, which effectively imparts an excellent press-formability and a superior corrosion resistance to the zinc-plated steel material, with only one application thereof.

Another object of the present invention is to provide a rust-preventive lubricant composition for a zinc-plated steel material, having a satisfactory removability from a zinc-plated steel material after a press-forming process.

Still another object of the present invention is to provide a rust-preventive lubricant composition for a zinc-plated steel material, effectively preventing the powdering and/or flaking phenomenon of the coated zinc layer on the steel material when a press-forming process is applied to the zinc-plated steel material.

The above-mentioned objects can be attained by the rust-preventive lubricant composition of the present invention for a zinc-plated steel material, which comprises (A) 70 to 97% by weight of a lubricant component comprising the sub-components of:

(a) an esterification product of succinic acid with an aliphatic alcohol having from 12 to 18 carbon atoms;

(b) a paraffin wax having a melting point of 45° C. to 55° C.; and (c) at least one member selected from the group consisting of esterification products of fatty acids having from 12 to 18 carbon atoms with aliphatic alcohols having from 6 to 10 carbon atoms; and mineral oils, the ratio of the total weight of the sub-components (a) and (b) to the weight of the sub-component (c) being from 1:3 to 1:1, and the ratio of the weight of the sub-component (a) to the weight of the sub-component (b) being from 1:3 to 4:1, and (B) 3 to 30% by weight of a rust-inhibiting component comprising at least one member selected from the group consisting of sulfonate having at least 16 carbon atoms, carboxylic acids having at least 12 carbon atoms and salts of the carboxylic acids, and having a melting point of from 25° C. to 40° C. and an acid value of less than 2.0.

DETAILED DESCRIPTION OF THE INVENTION

The inventors of the present invention carried out research into a rust-preventive lubricant composition for a zinc-plated steel material, to solve the above-mentioned problems of the prior art, and obtained the following findings.

(1) An esterification product of a specific dicarboxylic acid, i.e., succinic acid with an aliphatic alcohol which must have a specifically limited number of carbon atoms, is useful as a lubricant component of a lubricant composition effectively imparting an appropriate press-formability to a zinc-plated steel material.

(2) To provide a lubricant composition useful for imparting an appropriate press-formability and a satisfactory removability in a degreasing process prior to a phosphating process, to a zinc-plated steel material, a paraffin wax having a specifically restricted melting point must be contained in the lubricant composition.

(3) To provide a lubricant composition useful for imparting a satisfactory removability in the degreasing process prior to the phosphating process, and an excellent white rust-resistance, to a zinc-plated steel material, the lubricant composition must contain at least one member selected from the group consisting of (i) esterification products of specific fatty acids having a specifically restricted number of carbon atoms with an aliphatic alcohols having 6 to 10 carbon atoms, which esterification products have a limited low acid value; and (ii) mineral oils.

(4) To provide a lubricant composition capable of imparting an excellent corrosion resistance to a zinc-plated steel material, at least one member selected from the group consisting of specific sulfonates having at least 16 carbon atoms, specific carboxylic acids having at least 12 carbon atoms and salts of the carboxylic acids must be contained, as a rust-inhibiting component, in the lubricant composition.

(5) To impart an excellent lubricity even in hot weather, and a satisfactory degreasing, to a zinc-plated steel material, the lubricant composition must have a melting point of 25° C. to 40° C.

(6) To impart a high corrosion-resistance to a zinc-plated steel material, the lubricant composition must have an acid value limited to a level of not more than 2.0.

The present invention was completed on the basis of the above findings.

The lubricant component of the rust-preventive lubricant composition of the present invention comprises the sub-components (a), (b) and (c).

The sub-component (a) consists of an esterification product of succinic acid with an aliphatic alcohol having from 12 to 18 carbon atoms.

The aliphatic alcohol is preferably selected from the group consisting of lauryl alcohol, myristyl alcohol, palmityl alcohol, cetyl alcohol, oleyl alcohol, stearyl alcohol, beef tallow alcohols, and coconut oil alcohols.

In the sub-component (a), the dicarboxylic acid must be succinic acid. If the succinic acid is replaced by another dicarboxylic acid, for example, by oxalic acid, malonic acid, adipic acid, maleic acid or fumaric acid, the resultant lubricant composition provides an unsatisfactory lubrication, and thus is useless. When succinic acid is used, the resultant lubricant composition exhibits not only an excellent lubrication of a zinc-plated steel material but also a high resistance to foaming even when saponified into a soap.

If the number of the carbon atoms of the aliphatic alcohol for the sub-component (a) is less than 12, the resultant lubricated zinc-plated steel material exhibits an unsatisfactory press-formability and powdering resistance. Also, if the number of carbon atoms of the aliphatic alcohol is more than 18, the resultant lubricant composition exhibits a poor removability. Accordingly, the number of carbon atoms of the aliphatic alcohol must be restricted to from 12 to 18.

The influence of the number of carbon atoms of the aliphatic alcohol of the sub-component (a) on the various properties of the resultant lubricated zinc-plated steel material will be illustrated by Experiments 1 to 5 as indicated in Table 1.

In each of Experiments 1 to 5, a galvannealed steel sheet having two surface coating layers each having a weight of 45 g/m$^2$ and having a thickness of 0.8 mm, was degreased with trichloroethylene. A lubricant having the composition as indicated in Table 1 was diluted with a paraffin solvent in a mixing volume ratio of 50:50. The diluted lubricant composition was applied to the galvannealed steel sheet and dried by blowing hot air at a temperature of 80° C., to form a lubricant layer in a dry weight of 1.0 g/m$^2$.

The resultant lubricant-applied steel sheet was subjected to the press-forming test as indicated in Table 2. The press-formability of the tested steel sheet was evaluated and expressed in the manner as indicated in Table 2.

Also, the lubricant-applied steel sheet was subjected to the powdering test as shown in Table 3. The powdering resistance of the tested steel sheet was evaluated and represented in the manner as indicated in Table 3.

Further, the resultant lubricant-applied steel sheet was subjected to the corrosion test as indicated in Table 4. The corrosion-resistance of the tested steel sheet was evaluated and represented in the manner as indicated in Table 4.

Still further, the resultant lubricant-applied steel sheet was subjected to a degreasing test as indicated in Table 5. The removability of the lubricant layer on the tested steel sheet was evaluated and represented in the manner as shown in Table 5.

TABLE 1

| | | | Experiment No. | | | | |
|---|---|---|---|---|---|---|---|
| | | | 1 | 2 | 3 | 4 | 5 |
| Composition of lubricant (wt %) | Lubricant component (A-a) | $C_{10}$ alkyl succinate(*)$_1$ | 80 | — | — | — | — |
| | | $C_{12}$ alkyl succinate(*)$_2$ | — | 80 | — | — | — |
| | | $C_{16}$ alkyl succinate(*)$_3$ | — | — | 80 | — | — |
| | | $C_{18}$ alkyl succinate(*)$_4$ | — | — | — | 80 | — |
| | | $C_{20}$ alkyl succinate(*)$_5$ | — | — | — | — | 80 |
| | Rust-inhibiting coponent | Mixture of Ba dinonylnaphthalene sulfonate with Ba-salt | 20 | 20 | 20 | 20 | 20 |

TABLE 1-continued

| | | Experiment No. | | | | |
|---|---|---|---|---|---|---|
| | | 1 | 2 | 3 | 4 | 5 |
| (B) | of oxidized petroleum wax (1:1 by weight) | | | | | |
| Acid value of lubricant composition | | <0.5 | <0.5 | <0.5 | <0.5 | <0.5 |
| Performances of lubricant-applied galvannealed steel sheet | | | | | | |
| Press-formability(*)$_6$ | | 2 | 3 | 4 | 4 | 4 |
| Powdering resistance(*)$_7$ | | 2 | 3 | 4 | 4 | 4 |
| Corrosion resistance(*)$_8$ | | 3 | 3 | 3 | 3 | 3 |
| Removability of lubricant(*)$_9$ | | 2 | 2 | 2 | 2 | 1 |

(*)$_1$ Succinic acid - $C_{10}$-aliphatic alcohol ester
(*)$_2$ Succinic acid - $C_{12}$-aliphatic alcohol ester
(*)$_3$ Succinic acid - $C_{16}$-aliphatic alcohol ester
(*)$_4$ Succinic acid - $C_{18}$-aliphatic alcohol ester
(*)$_5$ Succinic acid - $C_{20}$-aliphatic alcohol ester
(*)$_6$ Classes 3 and 4 are satisfactory (Refer to Table 2)
(*)$_7$ Classes 3 and 4 are satisfactory (Refer to Table 3)
(*)$_8$ Classes 3 and 4 are satisfactory (Refer to Table 4)
(*)$_9$ Classes 3 and 4 are satisfactory (Refer to Table 5)
The degreasing test was carried out at 55° C.

TABLE 2

| Item | | Press-formability test Content | |
|---|---|---|---|
| Test machine | | Drawing test machine (Type TF102, made by Tokyo Koki Seisakusho) | |
| Test piece | | Diameter: 90 mm | |
| Test conditions | Type of die | SKD 11, diameter: 42.4 mm, Shoulder: 8R | |
| | Punch | SKD 11, diameter: 39.8 mm Shoulder: 8R | |
| | Blank holder pressure | 0.5 ton | |
| | Drawing speed | 40 cm/min | |
| Evaluation of test result (formability) | | Class 4: | More than 15% of percentage reduction (*)$_{10}$ |
| | | Class 3: | 10 to 15% of percentage reduction |
| | | Class 2: | 5 to 10% of percentage reduction |
| | | Class 1: | Less than 5% of percentage reduction |

Note:

$$(*)_{10}\ \text{Percentage reduction}\ (\%) = \left(1 - \frac{D_2}{D_1}\right) \cdot 100$$

wherein $D_1$ represents a diameter of a test piece before drawing and $D_2$ represents a diameter of the test piece after drawing.

TABLE 3

| Item | | Powdering resistance test Content | |
|---|---|---|---|
| Testing machine | | Triangular head (head redius: 0.5 mm) draw bead test machine made by Daito Seisakusho | |
| Dimension of test piece | | Width: 30 m<br>Length: 300 mm | |
| Test conditions | Drawing length | 200 mm | |
| | Bead height | 4 mm | |
| | Pressure | 500 kg | |
| | Drawing speed | 200 mm/min | |
| | Test piece temperature | Room temperature | |
| Powdering resistance test | | An adhesive tape was adhered to the tested piece and then peeled from the test piece. The peeled tape was placed on a white paper sheet and the amount of fine particles adhered to the adhesive tape was determined by naked eye observation. | |
| Evaluation of test result (powdering resistance) | | Class 4: | No fine particles were found on adhesive tape |
| | | Class 3: | Very small amount of fine particles |
| | | Class 2: | Larger amount of fine particles than class 3 |

TABLE 3-continued

| Item | Powdering resistance test Content | |
|---|---|---|
| | Class 1: | Large amount of fine particles |

TABLE 4

| Item | Corrosion resistance test Content | |
|---|---|---|
| Device | Controlled temperature and humidity cabinet<br>Type LHU-112, made by Tobai Seisakusho | |
| Test piece | Width: 70 mm<br>Length: 150 mm | |
| Test conditions | Temperature: 50° C.<br>Humidity: 98%<br>Stack force: 70 kgf · cm<br>Time: 14 days | |
| Evaluation of test result (corrosion resistance) | A ratio of the total area of white rusted surface portions to the entire area of the test piece surfaces was measured. | |
| | Class 4: | 0% of rusted surface area ratio |
| | Class 3: | Less than 10% but more than 0% of rusted surface area ratio |
| | Class 2: | Less than 25% but more than 10% of rusted surface area ratio |
| | Class 1: | 25% or more of rusted surface area ratio |

TABLE 5

| Item | Lubricant-removing test Content | |
|---|---|---|
| Device | Controlled temperature, and humidity cabinet<br>Type LHU-112, made by Tobai Seisakusho | |
| Test piece | Width: 70 mm<br>Length: 150 mm | |
| Degreasing conditions | Test pieces were stacked in the cabinet under a stack force of 70 kgf-cm for 96 hours, and then degreased under the following conditions. | |
| | Degreasing agent: | Fine Cleaner L 4480 (trademark, made by Nihon Parkerizing Co., Ltd.) |
| | Concentration: 18 g/liter | |
| | Temperature: 40° C. or 55° C. | |
| Evaluation of test result (Removability | The degreased test piece was rinsed by city water-showering for 30 seconds, and then the rinsed test piece was left to stand at room temperature for 30 seconds. | |

TABLE 5-continued

| Item | Lubricant-removing test Content |
|---|---|
| | Then it was determined whether the surface of the rinsed piece was wetted. The degreasing time necessary to cause the rinsed test piece to be completely water-wetted was determined. |
| | Class 4: One minute or less degreasing time |
| | Class 3: 3 minutes or less but more than one minute degreasing time |
| | Class 2: 5 minutes or less but more than 3 minutes degreasing time |
| | Class 1: More than 5 minutes degreasing time |

Table 1 clearly shows that, when succinic acid esters of aliphatic alcohols having 12 to 18 carbon atoms are used, the resultant lubricant-applied galvannealed steel sheet exhibit a satisfactory press-formability, powdering resistance and corrosion resistance, but the lack of the sub-components (b) and (c) results in an unsatisfactory removability of lubricant.

In the rust-preventive lubricant composition of the present invention, the paraffin wax for the sub-component (b) must have a melting point of 45° C. to 55° C. If the melting point of the paraffin wax is less than 45° C., the resultant lubricant-applied zinc-plated steel material exhibits unsatisfactory press-formability and powdering resistance. Also, if the melting point is more than 55° C., the resultant lubricant composition exhibits an unsatisfactory removability from the steel material.

The importance of the restriction of the melting point of the paraffin (sub-component (b)) to the range of from 45° C. to 55° C. will be illustrated by Experiments 6 to 10 as indicated in Table 6.

In each of Experiments 6 to 10, the same galvannealed steel sheet as mentioned in Experiments 1 to 5 was degreased and lubricant-treated in the same manner as in Experiments 1 to 5, except that the lubricant composition had the composition and acid value as shown in Table 6.

The test results of the resultant lubricant-applied galvannealed steel sheet are shown in Table 6. The tests were carried out in the manner as shown in Tables 2 to 5.

TABLE 6

| Item | | | Experiment No. 6 | 7 | 8 | 9 | 10 |
|---|---|---|---|---|---|---|---|
| Composition of lubricant composition (wt %) | Lubricant component (A-a) | $C_{16}$ alkyl succinate | 40 | 40 | 40 | 40 | 40 |
| | Lubricant component (A-b) | Paraffin wax, m.p: 40° C. | 40 | — | — | — | — |
| | | Paraffin wax, m.p: 45° C. | — | 40 | — | — | — |
| | | Paraffin wax, m.p: 50° C. | — | — | 40 | — | — |
| | | Paraffin wax, m.p: 55° C. | — | — | — | 40 | — |
| | | Paraffin wax, m.p: 60° C. | — | — | — | — | 40 |
| | Rust-inhibiting component (B) | Mixture of Ba dinonylnaphthalene-sulfonate with Ba-salt of oxidized petroleum wax (1:1 by weight) | 20 | 20 | 20 | 20 | 20 |
| Acid value of lubricant composition | | | <0.5 | <0.5 | <0.5 | <0.5 | <0.5 |
| Test result | | | | | | | |
| Press-formability | | | 2 | 3 | 4 | 4 | 4 |
| Powdering resistance | | | 2 | 3 | 4 | 4 | 4 |
| Corrosion resistance | | | 3 | 3 | 3 | 3 | 3 |
| Removability of lubricant $(*)_{11}$ | | | 4 | 3 | 3 | 3 | 2 |

Note: $(*)_{11}$Degreasing test was carried out at 55° C.

In the lubricant component (A) of the present invention, the sub-component (c) comprises at least one member selected from the group consisting of esterification products of fatty acids having from 12 to 18 carbon atoms with aliphatic alcohols having from 6 to 10 carbon atoms, and mineral oils.

The fatty acids usable for the present invention include lauric acid, myristic acid, palmitic acid, oleic acid, stearic acid, beef tallow fatty acids, and coconut oil fatty acid.

The aliphatic alcohols to be esterified with the fatty acids are selected from those having 6 to 10 carbon atoms, for example, hexyl alcohol, isooctyl alcohol, nonyl alcohol, decyl alcohol, and 2-ethyl-hexyl alcohol.

If the number of carbon atoms of the aliphatic alcohols is less than 6, the resultant lubricant composition exhibits an unsatisfactory lubrication of the zinc-plated steel material. Also, if the number of the carbon atoms is more than 10, the resultant lubricant composition applied to the zinc-plated steel material exhibits a poor removability.

If the number of carbon atoms of the fatty acids is less than 12, the resultant lubricant-applied zinc-plated steel material exhibits an unsatisfactory press-formability and powdering resistance. If the number of carbon atoms is more than 18, the resultant lubricant composition applied to the zinc-plated steel material exhibits a poor removability.

The importance of the restriction of the carbon atom number of the fatty acids to the range of from 12 to 18 will be illustrated by Experiments 11 to 17 as indicated in Table 7.

In each of Experiments 11 to 17, the same galvannealed steel sheet as mentioned in Experiments 1 to 5 was degreased and lubricant-treated in the same manner as in Experiments 1 to 5, except that the lubricant composition had the composition and acid value as shown in Table 7.

The fatty acid ester was an ester of a fatty acid having the carbon atom number as shown in Table 7 with 2-ethyl-hexyl alcohol.

The same tests as indicated in Tables 2 to 5 were applied to the resultant lubricant-applied galvannealed steel sheet. The test results are indicated in Table 7.

TABLE 7

| Item | | | Experiment No. 11 | 12 | 13 | 14 | 15 | 16 | 17 |
|---|---|---|---|---|---|---|---|---|---|
| Composition of lubricant composition | Lubricant component (A-a) | $C_{16}$ alkyl succinate | 40 | 40 | 40 | 40 | 40 | 40 | 40 |
| | | $C_{10}$ fatty acid ester $(*)_{12}$ | 40 | — | — | — | — | — | — |
| | | $C_{12}$ fatty acid ester $(*)_{12}$ | — | 40 | — | — | — | — | — |
| | Lubricant component (A-c) | $C_{16}$ fatty acid ester $(*)_{12}$ | — | — | 40 | — | — | — | 20 |
| | | $C_{18}$ fatty acid ester $(*)_{12}$ | — | — | — | 40 | — | — | — |
| | | $C_{20}$ fatty acid ester $(*)_{12}$ | — | — | — | — | 40 | — | — |
| | | Mineral oil | — | — | — | — | — | 40 | 20 |
| | Rust-inhibiting component (B) | Mixture of Ba dinonylnaphthalene-sulfonate with Ba-salt of oxidized petroleum wax (1:1 by weight) | 20 | 20 | 20 | 20 | 20 | 20 | 20 |
| Acid value of lubricant composition | | | <0.5 | <0.5 | <0.5 | <0.5 | <0.5 | <0.5 | <0.5 |
| Test result | | | | | | | | | |
| Press-formability | | | 2 | 3 | 4 | 4 | 4 | 4 | 4 |
| Powdering resistance | | | 2 | 3 | 4 | 4 | 4 | 4 | 4 |
| Corrosion resistance | | | 4 | 4 | 4 | 4 | 4 | 4 | 4 |
| Removability of lubricant $(*)_{13}$ | | | 3 | 3 | 3 | 3 | 2 | 3 | 3 |

Note:
$(*)_{12}$ $C_{16}$ fatty acid ester of 2-ethyl-hexyl ($C_8$) alcohol
$(*)_{13}$ The degreasing test was carried out at 40° C.

In the sub-component (c) of the present invention, the mineral oil is not limited to a specific type thereof as long as it exhibits a lubrication of the zinc-plated steel material similar to the above-mentioned fatty acid esters. Preferably, the mineral oil has a kinematic viscosity of 20 cSt or less at a temperature of 40° C.

The lubricant composition of the present invention contains a rust-inhibiting component (B) comprising at least one member selected from the group consisting of of sulfonates having at least 16 carbon atoms, preferably 16 to 20 carbon atoms, carboxylic acids having at least 12 carbon atoms, preferably 16 to 20 carbon atoms, and salts of the above-mentioned carboxylic acids.

The sulfonates having at least 16 carbon atoms usable for the present invention are preferably selected from the group consisting of alkali metal salts and alkaline earth metal salts of sulfonic acids, for example, Ba, Ca, Mg and Na salts of dinonylnaphthalenesulfonic acid, didodecylbenzenesulfonic acid, and petroleum sulfonic acids.

The carboxylic acids having at least 12 carbon atoms usable for the rust-inhibiting component (B) are preferably selected from the group consisting of isooleic acid, oleic acid, dimeric acids, alkenylsuccinic acids, and oxidized petroleum waxes.

The salts of the carboxylic acids having at least 12 carbon atoms may be selected from metal salts, for example, Ba, Ca, Mg and Na-salts, and amine salts of the above-mentioned carboxylic acids. The nitrogen-containing salt compounds of the carboxylic acids having at least 12 carbon atoms are selected from, for example, benzotriazole salts and imidazole salts of the above-mentioned carboxylic acids.

Preferable salts are barium dinonylnaphthalenesulfonate and barium salts of oxidized petroleum waxes. The rust-inhibiting component (B) comprises a single compound or a mixture of two or more of the above-mentioned specific compounds.

In the lubricant component (A) of the present invention, the ratio of the total weight of the sub-components (a) and (b) to the weight of the sub-component (c) must be in the range of from $\frac{1}{3}$ to 1/1. If the ratio (a+b)/(c) is less than $\frac{1}{3}$, the resultant lubricant-applied galvanized steel material exhibits an unsatisfactory press-formability and powdering resistance. Also, if the ratio (a+b)/(c) is more than 1/1, the resultant lubricant composition exhibits a poor removability when applied to the zinc-plated steel material.

The above-mentioned influence of the ratio (a+b)/(c) on the performances of the resultant lubricant-applied galvannealed steel sheet is illustrated by Experiments 18 to 22 as shown in Table 8.

In each of Experiments 18 to 22, the same galvannealed steel sheet as in Experiments 1 to 5 was treated in the same manner as in Experiments 1 to 5, except that the lubricant had the composition as shown in Table 8.

The same tests as in Tables 2 to 5 were applied to the resultant lubricant-applied galvannealed steel sheet. The test results are shown in Table 8.

TABLE 8

| Item | | | Experiment No. 18 | 19 | 20 | 21 | 22 |
|---|---|---|---|---|---|---|---|
| Composition of lubricant composition (wt %) | Lubricant sub-component (a) | $C_{16}$ alkyl succinate | 30 | 25 | 20 | 10 | 10 |
| | Lubricant sub-component (b) | Paraffin wax, m.p: 50° C. | 30 | 25 | 20 | 10 | 6 |
| | Lubricant sub-component (c) | Mixture of $C_{16}$ fatty acid ester $(*)_{14}$ with spindle oil No. 1 (1:1 by weight) | 20 | 30 | 40 | 60 | 64 |
| | Rust-inhibiting component (B) | Mixture of Ba dinonylnaphthalene-sulfonate with Ba-salt of oxidized petroleum wax | 20 | 20 | 20 | 20 | 20 |

TABLE 8-continued

| Item | Experiment No. 18 | 19 | 20 | 21 | 22 |
|---|---|---|---|---|---|
| (1:1 by weight) | | | | | |
| Ratio (a + b)/(c) | 3/1 | 5/3 | 1/1 | 1/3 | 1/4 |
| Acid value of lubricant composition | <0.5 | <0.5 | <0.5 | <0.5 | <0.5 |
| Test result | | | | | |
| Press-formability | 4 | 4 | 4 | 3 | 2 |
| Powdering resistance | 4 | 4 | 4 | 4 | 2 |
| Corrosion resistance | 4 | 4 | 4 | 4 | 4 |
| Removability of lubricant $(*)_{15}$ | 2 | 2 | 3 | 4 | 4 |

Note:
$(*)_{14}$ $C_{16}$ fatty acid ester of 2-ethyl-hexyl alcohol.
$(*)_{15}$ The degreasing temperature was 40° C.

Table 8 shows that, when the ratio (a+b)/(c) is less than ⅓, the resultant lubricant-applied galvannealed steel sheet exhibits an unsatisfactory press-formability and powdering resistance. Also, when the ratio (a+b)/(c) is more than 1/1, the resultant lubricant composition exhibits an unsatisfactory removability.

In the lubricant component (A) of the present invention, the ratio in weight of the sub-component (a) to the sub-component (b) is controlled to a level of 1:3 to 4:1.

If the ratio (a)/(b) is more than 4/1, the resultant lubricant exhibits an unsatisfactory removability, and a ratio (a)/(b) of less than ⅓ causes the resultant lubricant-applied zinc-plated steel sheet to exhibit an unsatisfactory press-formability and powdering resistance.

The above-mentioned influence of the ratio (a)/(b) on the performances of the resultant lubricant composition and lubricant-applied galvannealed steel sheet is shown by Experiments 23 to 27 as indicated in Table 9.

In each of Experiments 23 to 27, the same procedures as in Experiments 1 to 5 were carried out except that the lubricant had the composition as indicated in Table 9.

The same tests as in Tables 2 to 5 were applied to the resultant lubricant-applied galvannealed steel sheet. The test results are shown in Table 9.

In the lubricant composition of the present invention, the content of the lubricant component (A) is controlled to 70% to 97% by weight, and the content of the rust-inhibiting component (B) is regulated to 3 to 30% by weight.

When the content of the lubricant component (A) is less than 70% by weight or the content of the rust-inhibiting component (B) is more than 30% by weight the resultant lubricant-applied zinc-plated steel material exhibits an unsatisfactory press-formability and powdering resistance. Also, when the content of the lubricant component (A) is more than 97% by weight or the content of the rust-inhibiting component (B) is less than 3% by weight, the resultant lubricant-applied zinc-plated steel material exhibits an unsatisfactory corrosion resistance. This relationship is illustrated by Experiments 28 to 32 as shown in Table 10.

In each of Experiments 28 to 32, the same procedures as in Experiments 1 to 5 were carried out except that the lubricant had the composition as indicated in Table 10.

The same tests as in Tables 2 to 5 were applied to the resultant lubricant-applied galvannealed steel sheet. The test results are shown in Table 10.

TABLE 9

| Item | | | Experiment No. 23 | 24 | 25 | 26 | 27 |
|---|---|---|---|---|---|---|---|
| Composition of lubricant composition (wt %) | Lubricant sub-component (a) | $C_{16}$ alkyl succinate | 65 | 65 | 40 | 20 | 16 |
| | Lubricant sub-component (b) | Paraffin wax, m.p: 50° C. | 13 | 16 | 40 | 60 | 64 |
| | Rust-inhibiting component (B) | Mixture of Ba dinonylnaphthalene-sulfonate with Ba-salt of oxidized petroleum wax (1:1 by weight) | 22 | 20 | 20 | 20 | 20 |
| | Ratio (a)/(b) | | 5/1 | 4/1 | 1/1 | 1/3 | 1/4 |
| Acid value of lubricant composition | | | <0.5 | <0.5 | <0.5 | <0.5 | <0.5 |
| Test result | | | | | | | |
| Press-formability | | | 4 | 4 | 4 | 3 | 2 |
| Powdering resistance | | | 4 | 4 | 4 | 4 | 3 |
| Corrosion resistance | | | 3 | 3 | 3 | 3 | 3 |
| Removability of lubricant $(*)_{16}$ | | | 2 | 3 | 4 | 4 | 4 |

Note: $(*)_{16}$ The degreasing temperature was 55° C.

TABLE 10

| Item | | | Experiment No. 28 | 29 | 30 | 31 | 32 |
|---|---|---|---|---|---|---|---|
| Composition of lubricant composition (wt %) | Lubricant sub-component (a) | $C_{16}$ alkyl succinate | 15 | 20 | 20 | 20 | 20 |
| | Lubricant sub-com- | Paraffin wax, m.p: 50° C. | 15 | 20 | 20 | 20 | 20 |

TABLE 10-continued

| Item | | | Experiment No. 28 | 29 | 30 | 31 | 32 |
|---|---|---|---|---|---|---|---|
| | ponent (b) | | | | | | |
| | Lubricant sub-component (c) | Mixture of $C_{16}$ fatty acid ester $(*)_{17}$ with spindle oil No. 1 (1:1 by weight) | 30 | 30 | 40 | 57 | 60 |
| | Total | | 60 | 70 | 80 | 97 | 100 |
| | Rust-inhibiting component (A) | Mixture of Ba dinonylnaphthalene-sulfonate with Ba-salt of oxidized petroleum wax (1:1 by weight) | 40 | 30 | 20 | 3 | 0 |
| Acid value of lubricant composition | | | <0.5 | <0.5 | <0.5 | <0.5 | <0.5 |
| Test result | | | | | | | |
| Press-formability | | | 2 | 3 | 4 | 4 | 3 |
| Powdering resistance | | | 2 | 3 | 4 | 4 | 3 |
| Corrosion resistance | | | 4 | 4 | 4 | 3 | 1 |
| Removability of lubricant $(*)_{18}$ | | | 4 | 3 | 4 | 4 | 4 |

Note:
$(*)_{17}$ $C_{16}$ fatty acid-2-ethyl-hexyl alcohol ester
$(*)_{18}$ The degreasing temperature was 40° C.

The lubricant composition of the present invention has a melting point of from 25° C. to 40° C.

When the melting point is less than 25° C., the resultant lubricant composition exhibits an unsatisfactory lubrication of the zinc-plated steel material in hot weather, and when the melting point is more than 40° C., the resultant lubricant composition exhibits a poor removability.

The lubricant composition of the present invention has an acid value of less than 2.0. The acid value of the lubricant composition is mainly derived from the acid value of the fatty acid ester of the sub-component (c) of the lubricant component (A). When the acid value is 2 or more, the resultant lubricant-applied zinc-plated steel material exhibits an unsatisfactory corrosion resistance.

The influence of the acid value on the corrosion resistance of the resultant lubricant-applied galvannealed steel sheet is illustrated by Experiments 33 to 39 as shown in Table 11.

In each of Experiments 33 to 39, the same procedures as in Experiments 1 to 5 were carried out except that the lubricant had the composition as indicated in Table 11.

The same test as in Tables 2 to 5 were applied to the resultant lubricant-applied galvannealed steel sheet. The test results are shown in Table 11.

TABLE 11

| Item | | | Experiment No. 33 | 34 | 35 | 36 | 37 | 38 | 39 |
|---|---|---|---|---|---|---|---|---|---|
| Composition of lubricant composition (wt %) | Lubricant sub-component (a) | $C_{12}$ alkyl succinate | 40 | 40 | 40 | 40 | 40 | 40 | 40 |
| | Lubricant sub-component (b) | $C_{12}$ fatty acid ester $(*)_{19}$ (1) | 40 | — | — | — | — | — | — |
| | | $C_{12}$ fatty acid ester $(*)_{19}$ (2) | — | 40 | — | — | — | — | 20 |
| | | $C_{12}$ fatty acid ester $(*)_{19}$ (3) | — | — | 40 | — | — | — | — |
| | | $C_{12}$ fatty acid ester $(*)_{19}$ (4) | — | — | — | 40 | — | — | — |
| | | $C_{12}$ fatty acid ester $(*)_{19}$ (5) | — | — | — | — | 40 | — | — |
| | | Mineral oil | — | — | — | — | — | 40 | 20 |
| | Rust-inhibiting component (B) | Mixture of Ba dinonylnaphthalene-sulfonate with Ba-salt of oxidized petroleum wax (1:1 by weight) | 20 | 20 | 20 | 20 | 20 | 20 | 20 |
| Acid value of lubricant composition | | | 0.1 | 0.5 | 1.0 | 2.0 | 3.0 | 0.3 | 0.3 |
| Test result | | | | | | | | | |
| Press-formability | | | 4 | 4 | 4 | 4 | 4 | 4 | 4 |
| Powdering resistance | | | 4 | 4 | 4 | 4 | 4 | 4 | 4 |
| Corrosion resistance | | | 4 | 4 | 4 | 2 | 2 | 4 | 4 |
| Removability of lubricant $(*)_{20}$ | | | 3 | 3 | 3 | 3 | 3 | 3 | 3 |

Note:
$(*)_{19}$ $C_{12}$ fatty acid ester of 2-ethyl-hexyl alcohol. The esters (1) to (5) each had a different acid value from the other.
$(*)_{20}$ The degreasing temperature was 40° C.

There is no limitation of the plating metal for the steel material, as long as the plating metal is a zinc-containing metal. For example, the zinc-containing metal is selected from, for example, Zn, Zn-Ni, Zn-Fe, Zn-Al, Al-Zn and Zn-Fe/Fe-Zn.

There is no limitation of the coating method used when applying the lubricant composition of the present invention to the zinc-plated steel material, but usually the lubricant composition is applied to the zinc-plated steel material by a roll coating method, spraying method, or curtain flow method.

Also, there is no limitation of the amount of the lubricant composition layer coated on the zinc-plated steel material. To obtain a lubricant composition layer having a high resistance to powdering, flaking and cracking, the dry weight of the lubricant composition layer is preferably controlled to a level of from 0.4 to 3.0 g/m$^2$. To obtain the above-mentioned dry weight, it is important to control the viscosity of the lubricant composition to an appropriate level. The viscosity of the lubricant composition can be adjusted to the desired level by adding a volatile solvent thereto.

The rust-preventive lubricant composition of the present invention is specifically useful for the zinc-plated steel materials, for example, sheet and strip but the rust-preventive lubricant composition can be advantageously applied to other metal materials, for example, hot-rolled steel materials, hot-rolled, pickled steel materials, cold rolled steel materials and materials of other type of metals.

The rust-preventive lubricant composition of the present invention optionally contains an extreme-pressure additive comprising a sulfur- or phosphorus-containing compound in an amount of several percent or less, to enhance the press-formability and powdering resistance of the resultant lubricant-applied zinc-plated steel material.

The present invention will be further explained by the following specific examples.

EXAMPLES 1 TO 14

In each of Examples 1 to 14, a galvannealed steel sheet having a thickness of 0.8 mm and provided with coating layers each having a weight of 45 g/m$^2$ was used. The galvannealed steel sheet was degreased with trichloroethylene.

A lubricant composition having the composition as indicated in Table 12 was diluted with a paraffin solvent in a mixing volume ratio of 50:50, the diluted lubricant composition was applied to the two surfaces of the degreased galvannealed steel sheet by a roll coating method, and dried by blowing hot air at a temperature of 80° C. The resultant lubricant composition layers on the galvannealed steel sheet were in an weight of 1.0 g/m$^2$ on each surface.

The resultant lubricant-applied galvannealed steel sheet was subjected to the tests as indicated in Tables 2 to 5.

The test results are shown in Table 12.

TABLE 12

| Item | | | Example No. 1 | 2 | 3 | 4 | 5 | 6 | 7 | 8 | 9 | 10 | 11 | 12 | 13 | 14 |
|---|---|---|---|---|---|---|---|---|---|---|---|---|---|---|---|---|
| Composition of lubricant composition (wt %) | Lubricant sub-component (a) | $C_{12}$ alkyl succinate | 5 | 0 | 0 | 5 | 0 | 0 | 10 | 0 | 0 | 5 | 0 | 6 | 0 | 0 |
| | | $C_{16}$ alkyl succinate | 10 | 10 | 20 | 15 | 15 | 25 | 5 | 20 | 20 | 5 | 3 | 4 | 10 | 8 |
| | | $C_{18}$ alkyl succinate | 0 | 10 | 0 | 0 | 5 | 0 | 0 | 0 | 0 | 0 | 2 | 0 | 0 | 2 |
| | Lubricant sub-component (b) | Paraffin wax, m.p.: 47° C. | 15 | 0 | 20 | 0 | 12 | 0 | 15 | 5 | 0 | 30 | 0 | 10 | 0 | 10 |
| | | Parraffin wax, m.p.: 53° C. | 0 | 5 | 0 | 10 | 0 | 10 | 0 | 5 | 20 | 0 | 15 | 0 | 20 | 0 |
| | Lubricant sub-component (c) | $C_{12}$ fatty acid ester (*)$_{21}$ | 40 | 0 | 0 | 50 | 0 | 0 | 57 | 0 | 0 | 40 | 0 | 0 | 0 | 0 |
| | | $C_{16}$ fatty acid ester (*)$_{21}$ | 0 | 0 | 40 | 0 | 0 | 62 | 0 | 40 | 40 | 0 | 0 | 20 | 10 | 20 |
| | | $C_{18}$ fatty acid ester (*)$_{21}$ | 0 | 45 | 0 | 0 | 48 | 0 | 0 | 0 | 0 | 0 | 60 | 0 | 0 | 0 |
| | | Mineral oil(*)$_{22}$ viscosity: 12 cSt (40° C.) | 0 | 0 | 0 | 0 | 0 | 0 | 0 | 0 | 0 | 0 | 0 | 40 | 40 | 40 |
| | Rust-inhibiting component (B) | (*)$_{23}$ | 30 | 30 | 20 | 20 | 20 | 3 | 3 | 20 | 20 | 20 | 20 | 20 | 20 | 20 |
| | Weight ratio | (a + b)/(c) | 1/1.3 | 1/1.8 | 1/1 | 1/1.7 | 1/1.5 | 1/1.8 | 1/1.9 | 1/1.3 | 1/1 | 1/1 | 1/3 | 1/3 | 1/1.7 | 1/1 |
| | | (a)/(b) | 1/1 | 4/1 | 1/1 | 2/1 | 1.7/1 | 2.5/1 | 1/1 | 2/1 | 1/1 | 1/3 | 1/3 | 1/1 | 1/2 | 1/1 |
| Melting point of lubricant composition | | | 33 | 40 | 36 | 34 | 39 | 34 | 33 | 35 | 36 | 32 | 32 | 33 | 34 | 35 |
| Acid value of lubricant composition | | | <0.5 | <0.5 | <0.5 | <0.5 | <0.5 | <0.5 | <0.5 | <0.5 | <0.5 | <0.5 | <0.5 | <0.5 | <0.5 | <0.5 |
| Test result | Press formability | | 3 | 4 | 4 | 3 | 4 | 4 | 4 | 4 | 4 | 3 | 3 | 3 | 4 | 4 |
| | Powdering resistance | | 4 | 4 | 4 | 4 | 4 | 4 | 4 | 4 | 4 | 4 | 4 | 4 | 4 | 4 |
| | Corrosion resistance | | 4 | 4 | 4 | 4 | 4 | 3 | 3 | 4 | 4 | 4 | 4 | 4 | 4 | 4 |
| | Removability of lubricant | | 4 | 3 | 4 | 4 | 3 | 4 | 4 | 4 | 4 | 4 | 4 | 4 | 4 | 4 |

Note:
(*)$_{21}$ 2-ethyl-hexyl alcohol ($C_8$) ester of the fatty acid
(*)$_{22}$ Spindle oil No. 1
(*)$_{23}$ A mixture of Ba dinonylnaphthalenesulfonate with Ba-salt of oxidized petroleum wax in a mixing weight ratio of 1:1.

Table 12 clearly shows that when the lubricant composition of Examples 1 to 14 were applied, the resultant lubricant-applied galvannealed steel sheet were provided with a satisfactory press-formability, powdering resistance, corrosion resistance, and removability of the lubricant.

COMPARATIVE EXAMPLES 1 to 12

In each of Comparative Examples 1 to 12, the same procedures as in Example 1 were carried out except that the composition, the ratios (a+b)/(c) and (a)/(b), and the acid value of the lubricant composition were as indicated in Table 13.

The test results are also shown in Table 13.

TABLE 13

| Item | | | Comparative Example No. 1 | 2 | 3 | 4 | 5 | 6 | 7 | 8 | 9 | 10 | 11 | 12 |
|---|---|---|---|---|---|---|---|---|---|---|---|---|---|---|
| Composition of lubricant composition (wt %) | Lubricant sub-component (a) | $C_{10}$ alkyl succinate | 20 | 0 | 0 | 0 | 0 | 0 | 0 | 0 | 0 | 0 | | |
| | | $C_{16}$ alkyl succinate | 0 | 20 | 20 | 20 | 10 | 40 | 30 | 8 | 30 | 0 | (*)$_{27}$ | (*)$_{28}$ |
| | | Paraffin wax, m.p.: 50° C. | 20 | 0 | 12 | 12 | 6 | 20 | 6 | 32 | 20 | 0 | | |
| | Lubricant sub-component (b) | Paraffin wax, m.p.: 60° C. | 0 | 20 | 0 | 0 | 0 | 0 | 0 | 0 | 0 | 0 | | |
| | | $C_{10}$ fatty acid ester (*)$_{24}$ | 0 | 0 | 48 | 0 | 0 | 0 | 0 | 0 | 0 | 0 | | |
| | | $C_{12}$ fatty acid ester (*)$_{24}$ | 0 | 0 | 0 | 48 | 0 | 0 | 0 | 0 | 0 | 0 | | |
| | Lubricant sub-com- | $C_{16}$ fatty acid ester - mineral oil mixture (*)$_{25}$ | 40 | 40 | 0 | 0 | 64 | 30 | 36 | 40 | 50 | 0 | | |

TABLE 13-continued

| Item | | | Comparative Example No. 1 | 2 | 3 | 4 | 5 | 6 | 7 | 8 | 9 | 10 | 11 | 12 |
|---|---|---|---|---|---|---|---|---|---|---|---|---|---|---|
| | ponent (c) | $C_{18}$ fatty acid - pentaerythritol ester | 0 | 0 | 0 | 0 | 0 | 0 | 0 | 0 | 0 | 80 | | |
| | Rust-inhibiting component (B) | (*)$_{26}$ | 20 | 20 | 20 | 20 | 20 | 10 | 28 | 20 | 0 | 20 | | |
| | Weight ratio | (a + b)/(c) | 1/1 | 1/1 | 1/1.5 | 1/1.5 | 1/4 | 2/1 | 1/1 | 1/1 | 1/1 | — | | |
| | | (a)/(b) | 1:1 | 1/1 | 1.7/1 | 1.7/1 | 1.7/1 | 2/1 | 5/1 | 1/4 | 1.5/1 | — | | |
| Acid value of lubricant composition | | | <0.5 | <0.5 | <0.5 | 2.5 | <0.5 | <0.5 | <0.5 | <0.5 | <0.5 | <0.5 | — | — |
| Test result | Press formability | | 2 | 4 | 2 | 4 | 2 | 4 | 4 | 2 | 4 | 4 | 3 | 1 |
| | Powdering resistance | | 2 | 4 | 2 | 4 | 3 | 4 | 4 | 3 | 4 | 4 | 2 | 1 |
| | Corrosion resistance | | 4 | 4 | 4 | 2 | 4 | 4 | 4 | 4 | 1 | 3 | 1 | 4 |
| | Removability of lubricant | | 4 | 1 | 4 | 4 | 4 | 2 | 2 | 4 | 4 | 2 | 1 | 4 |

Note:
(*)$_{24}$ 2-ethyl-hexyl alcohol ester of the fatty acid
(*)$_{25}$ A mixture of $C_{16}$ fatty acid-2-ethyl-hexyl alcohol ester with spindle oil No. 1 in a mixing weight ratio of 1/1
(*)$_{26}$ A mixture of Ba of dinonylnaphthalenesulfonate acid with Ba-salt of oxidized petroleum wax in a mixing weight ratio of 1:1
(*)$_{27}$ A conventional press oil
(*)$_{28}$ A conventional rust-preventive oil As Table 13 clearly indicates, in Comparative Example 1 in which the sub-component (a) consisted of a succinate of a $C_{10}$ aliphatic alcohol, the resultant lubricant applied galvannealed steel sheet had an unsatisfactory press-formability and powdering resistance. In Comparative Example 2 in which the sub-component (b) consisted of a paraffin wax having a melting point of 60° C., the resultant steel product had an unsatisfactory removability of the lubricant. In Comparative Example 3 in which the sub-component (c) consisted of an ester of a $C_8$ fatty acid with $C_{10}$ aliphatic alcohol, the resultant steel product had an unsatisfactory press-formability and powdering resistance.

In Comparative Example 4 in which the sub-component (c) consisting of an esterification product of $C_{12}$ fatty acid with $C_8$ aliphatic alcohol had an acid value of 3.0 and the acid value of the resultant lubricant composition was 2.5, the resultant steel product had an unsatisfactory corrosion resistance. In Comparative Example 5 in which the weight ratio (a +b)/(c) was ¼, the resultant steel product had an unsatisfactory press-formability. In Comparative Example 6 in which the weight ratio (a+b)/(c) was 2/1, the resultant steel product had an unsatisfactory removability of the lubricant. In Comparative Example 7 in which the weight ratio (a)/(b) was 5/1, the resultant steel product had an unsatisfactory removability of the lubricant. In Comparative Example 8 in which the weight ratio (a)/(b) was ¼, the resultant steel product had an unsatisfactory press-formability. In Comparative Example 9 in which no rust-inhibiting component (B) was employed, the resultant steel product had an unsatisfactory corrosion resistance. In Comparative Example 10 in which the sub-component (c) consisted of an ester of $C_{18}$ fatty acid with pentaerythritol, the resultant steel product had an unsatisfactory removability of the lubricant.

In Comparative Example 11 in which a usual conventional press oil was used as a lubricant, the resultant steel product had an unsatisfactory powdering resistance, corrosion resistance and removability of the lubricant. In Comparative Example 12 in which a usual conventional rust-preventive oil was employed as a lubricant, the resultant steel product exhibited a very poor press-formability and powdering resistance.

We claim:

1. A rust-preventive lubricant composition for a zinc-plated steel material, comprising:

(A) 70 to 97% by weight of a lubricant component comprising the sub-components of:
(a) an esterification product of succinic acid with an aliphatic alcohol having from 12 to 18 carbon atoms;
(b) a paraffin wax having a melting point of 45° C. to 55° C.; and
(c) at least one member selected from the group consisting of esterification products of fatty acids having from 12 to 18 carbon atoms with aliphatic alcohols having from 6 to 10 carbon atoms, and mineral oils,
the ratio of the total weight of the sub-components (a) and (b) to the weight of the sub-component (c) being from 1:3 to 1:1, and the ratio of the weight of the sub-component (a) to the weight of the sub-component (b) being from 1:3 to 4:1, and (B) 3 to 30% by weight of a rust-inhibiting component comprising at least one member selected from the group consisting of sulfonates having at least 16 carbon atoms, carboxylic acids having at least 12 carbon atoms, and salts of the carboxylic acids, and having a melting point of from 25° C. to 40° C. and an acid value of less than 2.0.

2. The rust-preventive lubricant composition as claimed in claim 1, wherein, in the sub-component (a), the aliphatic alcohol is selected from the group consisting of lauryl alcohol, myristyl alcohol, palmityl alcohol, cetyl alcohol, oleyl alcohol, stearyl alcohol, beef tallow alcohols, and coconut oil alcohols.

3. The rust-preventive lubricant composition as claimed in claim 1, wherein, in the sub-component (c), the fatty acids are selected from the group consisting of lauric acid, myristic acid, palmitic acid, oleic acid, stearic acid, beef tallow fatty acid and coconut oil fatty acid, and the aliphatic alcohols are selected from the group consisting of hexyl alcohol, isooctyl alcohol, nonyl alcohol, decyl alcohol and 2-ethyl-hexyl alcohol.

4. The rust-preventive lubricant composition as claimed in claim 1, wherein, in the sub-component (c), the mineral oils have a kinematic viscosity of 20 cSt or less at a temperature of 40° C.

5. The rust-preventive lubricant composition as claimed in claim 1, wherein, in the rust-inhibiting component (B), the sulfonate are selected from the group consisting of metal salts of dinonylnaphthalenesulfonate, didodecylbenzenesulfonate and petroleum sulfonates.

6. The rust-preventive lubricant composition as claimed in claim 1, wherein, in the rust-inhibiting component (B), the carboxylic acids are selected from the group consisting of isooleic acid, oleic acid, dimeric acids, alkenylsuccinates, and petroleum oxidized waxes.

7. The rust-preventive lubricant composition as claimed in claim 1, wherein, in the rust-inhibiting component (B), the salts of the carboxylic acids are selected from the group consisting of metal salts and amine salts of isooleic acid, oleic acid, dimeric acids, alkylenesuccinates and petroleum oxidized waxes.

8. The rust-preventive lubricant composition as claimed in claim 1, wherein the rust-inhibiting component (B) comprises at least one member selected from the group consisting of barium dinonylnaphthalenesulfonate and barium salts of petroleum oxidized waxes.

* * * * *